US010259135B2

(12) United States Patent
Pellenc

(10) Patent No.: US 10,259,135 B2
(45) Date of Patent: Apr. 16, 2019

(54) CHAINSAW APPARATUS HAVING LUBRICATING SYSTEM

(71) Applicant: Roger Pellenc, Pertuis (FR)

(72) Inventor: Roger Pellenc, Pertuis (FR)

(73) Assignee: PELLENC (Societe Anonyme), Pertuis (FR)

( * ) Notice: Subject to any disclaimer, the term of this patent is extended or adjusted under 35 U.S.C. 154(b) by 219 days.

(21) Appl. No.: 15/360,017

(22) Filed: Nov. 23, 2016

(65) Prior Publication Data

US 2017/0072584 A1 Mar. 16, 2017

Related U.S. Application Data

(63) Continuation-in-part of application No. 12/527,676, filed as application No. PCT/FR2008/000245 on Feb. 25, 2008, now abandoned.

(30) Foreign Application Priority Data

Feb. 26, 2007 (FR) ..... 07 01357

(51) Int. Cl.
*B27B 17/12* (2006.01)
*B27B 17/02* (2006.01)
*B27B 17/00* (2006.01)

(52) U.S. Cl.
CPC ..... *B27B 17/12* (2013.01); *B27B 17/0008* (2013.01); *B27B 17/02* (2013.01)

(58) Field of Classification Search
CPC ..... B27B 17/00; B27B 17/0008; B27B 17/02; B27B 17/12
USPC ..... 30/381–387; 83/169; 184/15.1–15.3
See application file for complete search history.

(56) References Cited

U.S. PATENT DOCUMENTS 3,717,221 A * 2/1973 Densow ..... F16N 29/04 184/15.1
3,967,698 A * 7/1976 Smith ..... B23Q 11/10 184/15.2
4,175,909 A * 11/1979 White ..... B23D 59/006 30/381
4,341,017 A * 7/1982 Janczak ..... A01G 3/08 30/381
4,632,648 A * 12/1986 Goyne ..... F16N 13/22 184/35
4,636,147 A * 1/1987 Schweitzer ..... B27B 17/12 184/15.1

(Continued)

*Primary Examiner* — Jason Daniel Prone
(74) *Attorney, Agent, or Firm* — Egbert, McDaniel & Swartz, PLLC

(57) ABSTRACT

A chainsaw apparatus has a guide bar, a drive sprocket, and endless cutting chain mounted over the guide bar and over the drive sprocket, a first motor drivingly connected to the drive sprocket so as to cause the drive spot sprocket to move the endless chain over the guide bar, the first control device for controlling operation of the first motor and configured to deliver at least one first data representative of an operation of the motor, a storage tank suitable adapted to receive a lubricating fluid therein, a pump cooperative with the storage tank so as to deliver the lubricating fluid toward the guide bar and the endless cutting chain, a second motor drivingly connected to the pump, and a second control device for controlling operation of the second motor on the basis of a lubricating control parameter derived from the first data. The second motor is an electric motor.

2 Claims, 2 Drawing Sheets

(56) References Cited

U.S. PATENT DOCUMENTS 4,644,658 A * 2/1987 Dolata ..... B27B 17/12 30/381
4,662,071 A * 5/1987 Hoppner ..... F16N 13/10 184/15.1
4,683,659 A * 8/1987 Wunsch ..... B27B 17/12 184/15.1
4,884,340 A * 12/1989 Newman ..... A01D 34/90 30/383
4,967,882 A * 11/1990 Meuer ..... B60R 17/02 184/6.4
4,981,129 A * 1/1991 Osterman ..... B27B 17/02 30/384
5,002,135 A * 3/1991 Pellenc ..... A01G 3/037 30/228
5,184,403 A * 2/1993 Schliemann ..... B27B 17/12 30/382
5,533,432 A * 7/1996 Ornberg ..... A01G 23/091 30/386
6,178,960 B1 * 1/2001 Svensson ..... B23D 57/0015 30/381
7,356,975 B2 * 4/2008 Kirk ..... B65B 9/15 30/228
8,225,907 B2 * 7/2012 Soucy ..... B27B 17/12 184/15.1
8,844,678 B2 * 9/2014 Ilmarinen ..... F16N 11/08 184/6.14
9,603,314 B2 * 3/2017 Voss ..... A01G 23/081
2005/0086813 A1 * 4/2005 Champlin ..... A01G 3/08 30/296.1
2009/0151173 A1 * 6/2009 Galster ..... B27B 17/12 30/385
2010/0083513 A1 * 4/2010 Pellenc ..... B27B 17/08 30/383
2011/0005088 A1 * 1/2011 Pellenc ..... B27B 17/0008 30/383
2011/0186319 A1 * 8/2011 Pellenc ..... B25F 5/00 173/176
2017/0129124 A1 * 5/2017 Lindsay ..... B27B 17/0016
2017/0348712 A1 * 12/2017 Marino ..... F04B 1/14
2017/0348736 A1 * 12/2017 Marino ..... F04B 1/14
2018/0036903 A1 * 2/2018 Stahlkrantz ..... B27B 17/025
2018/0043566 A1 * 2/2018 Liliegard ..... B27B 17/12
2018/0043567 A1 * 2/2018 Johansson ..... B23D 59/001
2018/0050463 A1 * 2/2018 Johansson ..... B27B 17/04
2018/0065269 A1 * 3/2018 Stahlkrantz ..... B27B 17/02
2018/0065270 A1 * 3/2018 Sarius ..... B27B 17/02
2018/0065271 A1 * 3/2018 Sarius ..... B27B 33/14
2018/0071943 A1 * 3/2018 Lilja ..... B27B 33/142

* cited by examiner

CHAINSAW APPARATUS HAVING LUBRICATING SYSTEM

CROSS-REFERENCE TO RELATED U.S. APPLICATIONS

The present application is a continuation-in-part of U.S. patent application Ser. No. 12/527,676, filed on Aug. 18, 2009, and entitled "Chain Saw Provided with a Lubrication Device and Method Implemented for Performing Said Lubrication", presently pending.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention concerns a chain saw provided with a lubrication device for the guide bar/cutting chain assembly. It also deals with the method implemented for performing this lubrication.

2. Description of Related Art Including Information Disclosed Under 37 CFR 1.97 and 37 CFR 1.98.

Such tools with cutting chains, commonly called chain saws, are well known and are commonly used to cut up various materials (wood, concrete, bricks, tiles etc.). They include a cutting device constituted by an endless cutting chain mounted so as to turn around a drive sprocket and a chain guide generally of an oblong shape and equipped with a peripheral guide rail and a power source (for example constituted by a combustion engine or an electric motor) performing the drive of this chain, through the intermediary of said sprocket.

For the proper operation of a tool of this kind, it is indispensable to ensure efficient lubrication between the guide bar and the cutting chain in order to reduce the friction generating heat, loss of efficiency, accelerated wear and over-consumption of energy.

For this purpose, a lubrication fluid is stored in a tank where it is picked up before being directed, over an appropriate conduit, towards the guide bar/cutting chain assembly. The transmission of the lubrication fluid to the guide bar/cutting chain assembly is generally performed through the intermediary of a pump. It is sometimes obtained by gravity (not very efficient) or by pressurizing the storage tank (difficult dosage because it depends on the pressure and varies accordingly).

When the lubricating fluid is transported to the guide bar/cutting chain assembly by a pump, which is most often the case, this pump and the cutting chain are driven by the same motor or engine. Lubrication of the chain is then performed constantly and proportionally to the rotational speed of this motor or engine which leads to significant consumption of the lubricating fluid, without being necessarily always adequate for particularly difficult operating conditions which accompany a braking of the chain and a slowing down of the engine or motor, and consequently less lubrication of the chain.

The document FR 2 505 719 describes a device of this kind. According to this document, the electro-magnetic lubricating pump of the chain saw is actuated by the combustion motor driving the chain of the chain saw, through the intermediary of a magneto and a micro-calculator.

More concretely, with the current lubrication methods and systems, proper dosage of the quantity of oil taken from the tank is difficult because the output of the pump increases with the rotational speed of the engine and can lead to the useless delivery of too large volumes of oil. Furthermore, since this speed is reduced when more force is required for the cut, one reduces also the quantity of oil delivered to the chain when this is the moment where good lubrication would be necessary in order to reduce overheating and wear.

The invention aims at least at improving the efficiency of the lubrication of the guide bar/cutting chain assembly of chain saws and their drive sprocket by reducing the consumption of lubricating fluid and avoiding splashing the operator which happens frequently and causes stains and burns.

BRIEF SUMMARY OF THE INVENTION

A chainsaw apparatus comprises a guide bar, a drive sprocket, an endless cutting chain mounted over the guide bar and the drive sprocket, a first motor drivingly connected to the drive sprocket so as to cause the drive sprocket to move the endless chain over the guide bar, a first control device for controlling operation of the first motor and configured to deliver at least one first data representative of operation of the first motor, a storage tank adapted to receive a lubricating fluid therein, a pump cooperative with the storage tank so as to deliver the lubricating fluid toward the guide bar and the endless cutting chain, a second motor drivingly connected to the pump, and a second control device for controlling operation of the second motor based on a lubricating control parameter derived from the first data. The second motor is an electric motor.

The chainsaw apparatus of the present invention may also include at least one sensor. The sensor can be a temperature sensor, a flow sensor, or a level sensor. The sensor is capable of delivering at least one second data. If the sensor is a temperature sensor, the second data is representative of a temperature of the guide bar. If the sensor is a flow sensor, the second data is representative of a flow rate of the lubricating fluid. If the sensor is a level sensor, the second data is representative of a lubricating fluid level in the storage tank. The lubricating control parameter is further derived from the second data.

Additionally, the first motor can be an electric motor. The first data is at least one data from among a data related to an electric current consumed by the first motor and the data relating to a torque of the first motor during operation of the chainsaw apparatus.

The second control device is configured to command intermittent operation of the second motor.

According to another interesting characteristic arrangement of the invention, that is applicable to pole-mounted chain saws, according to which a saw head, comprising the different components of the cutting device and their drive system, is mounted at the high end of a pole. The lower end of which is provided with a control handle, the lubricating fluid storage tank and the electric pump for distributing this lubricating fluid are installed at the handle. A flow duct for the lubricating fluid connects the storage tank to the cutting device, this duct being preferably housed in the pole.

The aim of the invention is also a method for lubricating the cutting chain of a chain saw such as defined above, in which the outflow from the lubricating fluid distribution pump is controlled, based on the value of at least one operating parameter or factor of the chain saw.

Another advantageous characteristic of this method can be that doses of lubricating fluid are dispensed intermittently to the cutting device.

According to a mode of implementation of this method, the doses of lubricating fluid are dispensed by spacing the actuations of these doses at a substantially constant interval, said doses containing quantities of lubricating fluid based on the parameter or operating factor.

The lubricating device and method according to the invention offer several very interesting advantages:

- they allow an entirely automatic dosing of the lubrication, thus resulting in a very significant reduction of the generated heat and wear of the guide bar/cutting chain assembly;
- they produce a better dosing of the oil for a good operation of the cutting device, whatever the working conditions of the tool may be, resulting in significantly reduced oil consumption; and
- they are suitable for hand-held chain saws as well as for pole-mounted chain saws.

This foregoing Section is intended to describe, with particularity, the preferred embodiments of the present invention. It is understood that modifications to these preferred embodiments can be made within the scope of the appended claims. As such, this Section should not to be construed, in any way, as limiting of the broad scope of the present invention. The present invention should only be limited by the following claims and their legal equivalents.

BRIEF DESCRIPTION OF THE SEVERAL VIEWS OF THE DRAWINGS

The invention will be better understood when reading the description below, provided solely as an example and with reference being made to the attached drawings.

DETAILED DESCRIPTION OF THE INVENTION

Reference to the drawings is made to describe an advantageous, although by no means limiting, example of production of the chain saw and the method of implementation of its lubricating system according to the invention.

A pole-mounted chain saw 1 is described hereafter but it is emphasized that the invention is also applicable to hand-held chain saws of all types (with a single handle, a raised handle etc.) intended for all kinds of work (pruning, forestry, sawing of various materials . . . )

Figures 1, 2:
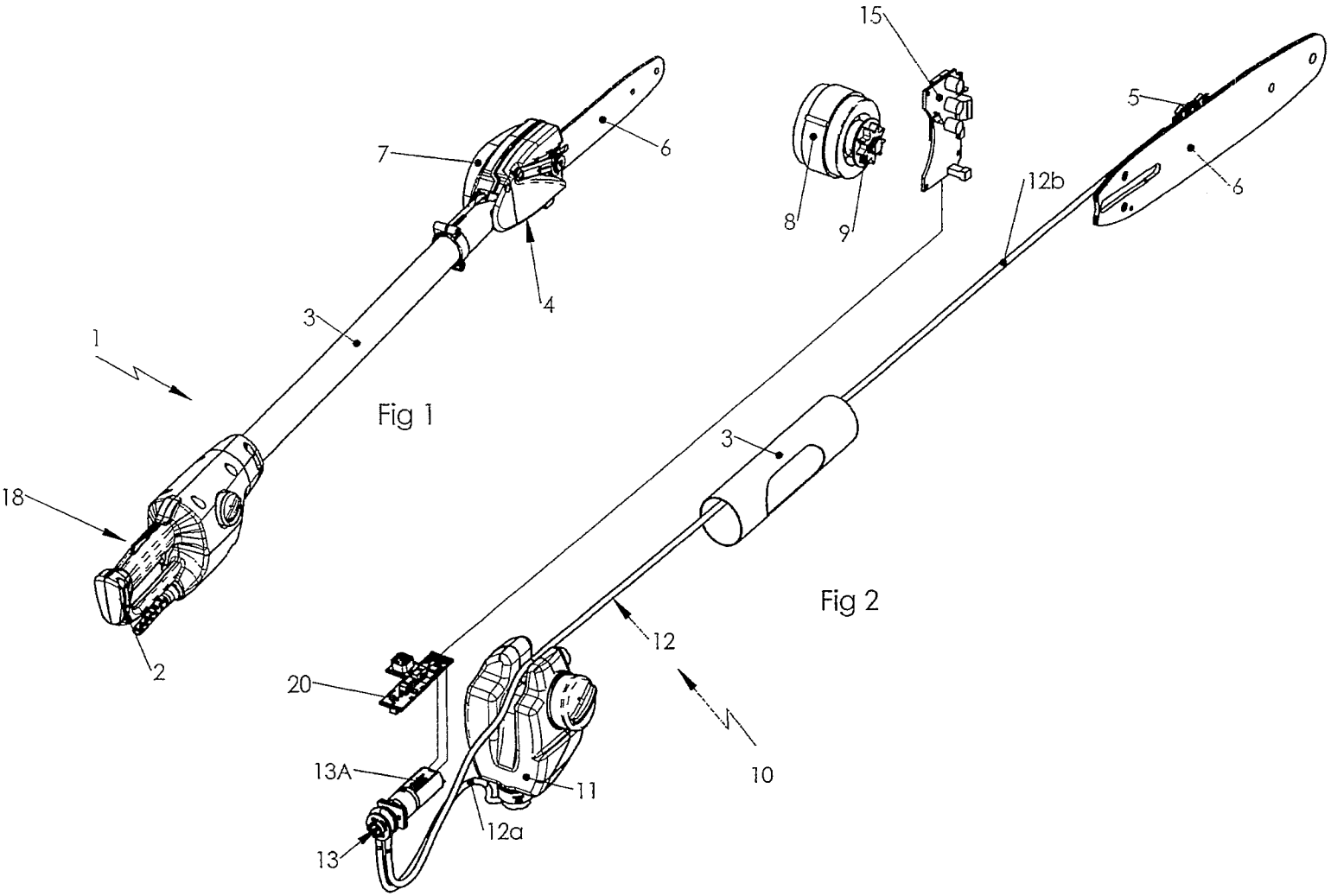
FIG. 1 is a perspective view of a pole-mounted chain saw to which the invention can be applied.
FIG. 2 is a perspective view with a break-away portion, showing the chain saw equipped with the lubricating device for its cutting elements.

FIG. 1 shows a pole-mounted chain saw which has a control handle 2 mounted at the lower end of a tubular pole 3, at the upper portion of which is mounted, in a free-turning manner, a cutting head 4.

The cutting head 4 includes an endless cutting chain 5 mounted at the periphery of a guide bar 6 and a drive sprocket 9. The drive of this cutting chain 5, via the drive sprocket 9, is powered by an electric motor located inside a housing 7 in FIG. 1 and referenced by the number 8 in FIG. 3. One does not exclude the realization of this drive by means of a combustion engine.

As one can see in FIG. 2 in which the pole 3 is partially shown, a lubricating device of the cutting system (guide bar 6, chain 5 and drive sprocket 9) is mounted at the lower end of the pole 3, at the handle 2. This lubricating device designated in its entirety by the reference number 10 includes a storage tank 11 which is intended for containing a quantity of lubricating fluid such as oil and which communicates with a supply duct 12 to deliver this fluid to the cutting head 4. On this duct 12, a pump 13 is connected for the delivery of the lubricating fluid to the cutting head.

According to a first characteristic arrangement of the invention, the pump 13 is coupled to an electric drive motor 13*a*, which is independent from the drive motor 8 of the cutting chain 5 of the cutting device 5-6 and is an integral part of the tool.

Advantageously, the electric pump 13 is a positive displacement pump capable of delivering the lubricating fluid intermittently, in the form of successive doses, to the cutting head 4. Preferably, it is a peristaltic pump, which has the advantage of being simple, sturdy and reliable. However, the electric pump 13 delivering the lubricating fluid may be constituted by any other type of appropriate pump, such as a diaphragm pump, or a plunger pump, or a vane pump, or a gear pump.

The tank 11, the pump 13 and its electric drive motor 13*a* are accommodated in the housing delimiting the handle 2, from which exits the aspiration section 12*a* of the duct 12. The lift section 12*b* of this duct 12, preferably constituted by a flexible pipe, then advances inside the pole 3. In a manner known as such, it extends into the guide bar 6 in the form of a distribution hole made in the latter and coming out under the chain 5.

According to another important characteristic arrangement, the electric drive motor 13*a* of the pump 13 is controlled by an appropriately configured electronic card 20, and the chain saw features at least one sensor to be able to transmit, to said electronic card, information relative to at least one parameter or operating factor of said chain saw.

Figure 3:
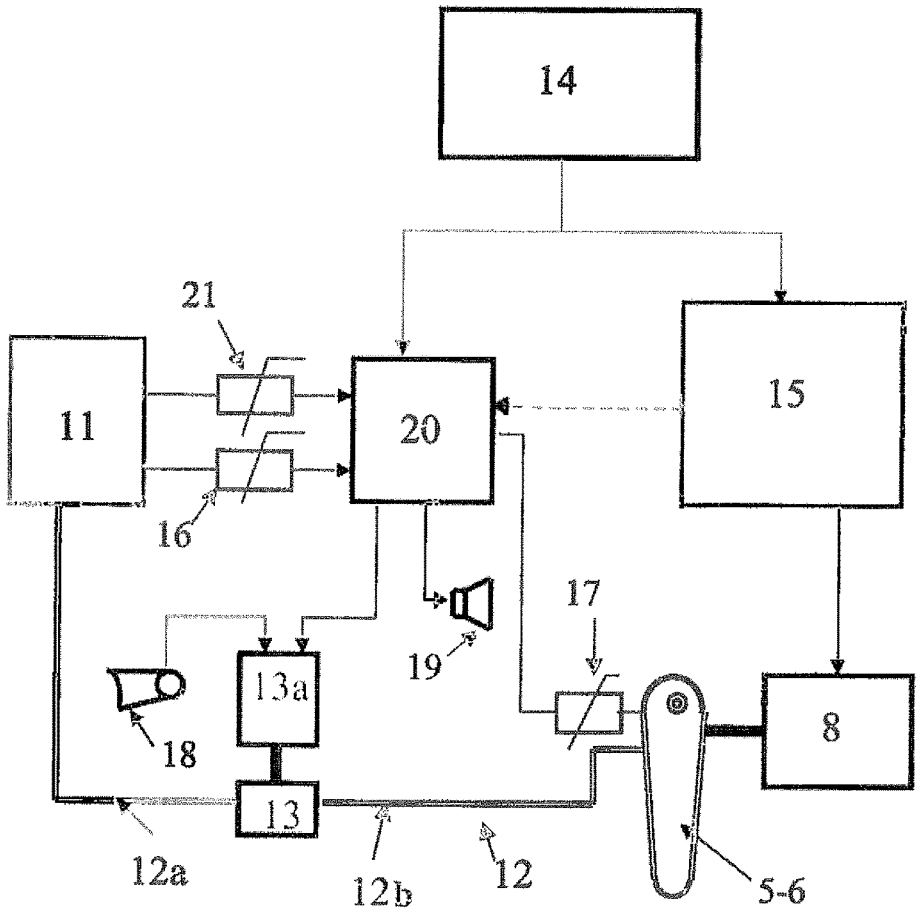
FIG. 3 is a block diagram of the lubricating device of FIG. 2 and an appertaining electric circuit.

Reference is now made to the block diagram of FIG. 3 to describe more completely the lubrication system and method according to the invention.

Preferably, the drive motor 8 of the cutting chain 5 is constituted by an electric motor, and this electric motor is likewise controlled by an electronic card 15.

A single storage battery 14 of electric energy, preferably constituted by a portable battery, can supply both the motor 13*a* of the electric pump 13 as well as the electric drive motor 8 of the cutting device 5-6.

The electronic control card 20 of the electric pump receives data concerning the electric current consumed by the electric drive motor 8 of the cutting chain, and/or relating to the torque of said motor 8, via the electronic control card 15 of the latter, during operation of the chain saw.

The electronic control card 20 of electric motor 13*a* of pump 13 receives and processes data sent from one or several sensors. For instance, the chain saw is equipped with:

- a sensor 17 capable of transmitting, to the electronic control card 20, data concerning the temperature of the guide bar 6; and/or a sensor 16 capable of transmitting, to said electronic control card 20, data relative to the rate of flow of the lubricating fluid, toward the cutting device 5-6; and a sensor 21 capable of transmitting, to said electronic card 20, data concerning the level of lubricating fluid contained in the tank 11.

The electronic control card 20 of the electric motor 13*a* of pump 13 may be configured to control the variable speed drive of said pump, on the basis of at least one parameter derived from the data relative to the electric current consumed by the drive motor 8 of the chain saw, to the torque of this motor, and/or derived from the temperature sensor 17, or from the oil flow rate sensor 16, or from the lubrication level sensor 21.

The electronic control card 20 of the electric motor 13*a* of pump 13 is advantageously configured to command intermittent operation of this pump in order to transmit doses or quantities of lubricating fluid, to the cutting system 5-6.

The electronic control card 20 is configured so that the delivery of successive doses of lubricating fluid is spaced at a substantially constant rate and so that the quantities of lubricating fluid are based on at least one of the aforementioned parameters or operating factors.

The drive pump 13 of the lubricating fluid is constituted by a positive displacement pump, for instance a peristaltic pump, or a diaphragm pump, or a plunger pump, or a vane pump, or gear pump.

Preferably, and as indicated above, the chain saw features sensor 21 capable of detecting an insufficient level of lubricating fluid in the tank 11. The insufficiencies of the oil flow or level, observed by the sensors result in the trigger, via the electronic control card 20, a visual or acoustic signal 19.

In the application of the invention to pole-mounted chain saws (FIGS. 1 and 2), according to which a saw head 4, comprising the various elements of the cutting device 5-6 and of their drive system 8, is mounted at the high end of a pole 3 the lower end of which is equipped with a control handle 2, the storage tank 11 of the lubricating fluid and the electric motor 13*a* of pump 13 for distributing this lubricating fluid, are installed near the handle 2. A duct 12 for transporting the lubricating fluid connects the storage tank 11 to the cutting device 5-6 via said pump, this duct 11 being preferably housed in the pole 3.

In this application, the electronic control card 20 of the electric motor 13*a* of pump 13 may be installed near the handle 2, whereas the electronic control card 15 of the drive motor 8 of the cutting chain 5 may be positioned near the cutting head 4.

In other applications, such as the chain saws with a simple handle or with a raised handle, the components of the electronic control cards 15 and 20 may be placed together on a single support and installed near the control handle of the tool.

Advantageously, the chain saw according to the invention also features an arrangement allowing direct actuation of the electric pump 13-13*a* from a manual control element, for example the trigger 18, that is accessible on the handle 2 of the tool, so that, preferably continuously, oil can be sent to the guide bar/cutting chain assembly 5-6, without passing through the electronic control card 20 of said electric pump 13-13*a*. Such forced lubrication is, for instance, used to make the oil rise from the tank 11 to the cutting head 5-6 at the first commissioning of the tool, or when the aspiration section 12*a* is empty, before the actuation of the motor 8, or to obtain a bleed down of the oil distribution orifice made in the guide bar 6.

According to the method of the invention, the electric pump 13-13*a* for distributing the lubricating fluid is controlled by means of an electronic card 20 on the basis of at least one parameter or operating factor of the chain saw.

According to an advantageous mode of execution, doses of lubricating fluid are sent intermittently to the cutting device 5, 6.

Preferably, in this case, doses of lubricating fluid are sent, while spacing the actuations of these doses at a substantially constant rate, said doses containing quantities of lubricating fluid, which are based on said parameter or operating factor.

I claim:

1. A chainsaw apparatus comprising:

a guide bar;

a drive sprocket;

an endless cutting chain mounted over said guide bar and said drive sprocket;

a first motor drivingly connected to said drive sprocket so as to cause said drive sprocket to move said endless chain over said guide bar;

a first control device for controlling operation of said first motor, said control device being configured to deliver at least one first data representative of an operation of said first motor;

a storage tank adapted to receive a lubricating fluid therein;

a pump cooperative with said storage tank so as to deliver the lubricating fluid toward said guide bar and said endless cutting chain;

a second motor drivingly connected to said pump, said second motor being an electric motor; and a second control device for controlling operation of said second motor by a lubricating control parameter derived from the at least one first data, the at least one data being provided by said first control device, wherein said first motor is an electric motor, wherein the at least one data is a data function of an electric current consumed by said first motor and a data function of a torque of said first motor during operation of the chainsaw apparatus.

2. The chainsaw apparatus of claim 1, further comprising:

at least one sensor selected from the group consisting of a temperature sensor, a flow sensor and a level sensor, the temperature sensor delivering at least one second data representative of a temperature of said guide bar, the flow sensor delivering a flow rate of the lubricating fluid, the level sensor delivering a data representative of a lubricating fluid level in said storage tank, the lubricating control parameter being derived further from said second data, the at least one sensor being connected to said second control device so as to deliver the at least one second data to said second control device, said second control device controlling an operation of said second motor as a function of the at least one second data.

* * * * *